US008446244B1

(12) United States Patent
Kuang et al.

(10) Patent No.: US 8,446,244 B1
(45) Date of Patent: May 21, 2013

(54) INTEGRATED MAGNETIC ELEMENT

(75) Inventors: Liangtang Kuang, Shanghai (CN); Yani Zhang, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/472,171

(22) Filed: May 15, 2012

(30) Foreign Application Priority Data

Oct. 31, 2011 (CN) ..... 2011 2 0424622 U

(51) Int. Cl.
*H01F 17/04* (2006.01)
*H01F 27/28* (2006.01)

(52) U.S. Cl.
USPC ..... 336/221; 336/220; 336/222; 336/223; 336/232

(58) Field of Classification Search
USPC ..... 336/220, 221, 222, 223, 232
See application file for complete search history.

(56) References Cited

U.S. PATENT DOCUMENTS 6,972,657 B1 * 12/2005 Pacala et al. ..... 336/200
7,656,261 B2 * 2/2010 Teng et al. ..... 336/192
8,325,004 B2 * 12/2012 Nagano et al. ..... 336/221
8,400,250 B2 * 3/2013 Nagano et al. ..... 336/212

* cited by examiner

*Primary Examiner* — Mohamad Musleh
*Assistant Examiner* — Joselito Baisa
(74) *Attorney, Agent, or Firm* — Kirton McConkie; Evan R. Witt

(57) ABSTRACT

An integrated magnetic element includes a conductive base, a bobbin, a winding coil, a first magnetic core assembly and a second magnetic core assembly. The conductive base includes a first conductive unit including a plurality of first conductive winding parts, a second conductive unit including at least one second conductive winding part, and a connecting part. The bobbin includes a bobbin body, a winding section, a channel and a plurality of insertion slots. The first conductive winding parts are inserted into corresponding insertion slots of the bobbin. The first magnetic core assembly is sheathed around the bobbin and partially embedded into the channel of the bobbin and the first holes of the first conductive winding parts. The second magnetic core assembly is sheathed around the second conductive unit of the conductive base and partially embedded into the second hole of the second conductive winding part.

10 Claims, 4 Drawing Sheets

INTEGRATED MAGNETIC ELEMENT

FIELD OF THE INVENTION

The present invention relates to a magnetic element, and more particularly to an integrated magnetic element.

BACKGROUND OF THE INVENTION

Magnetic elements such as inductors and transformers are widely used in power supply apparatuses or many electronic devices to generate induced magnetic fluxes. A transformer is a device that transfers electric energy from one circuit to another through coils in order to regulate the voltage to a desired range required for powering the electronic device.

Take a switching power supply for example. The power conversion circuit of the switching power supply comprises magnetic elements. The magnetic elements include a transformer and an inductor. The transformer and the inductor are electrically connected with each other. FIG. 1 schematically illustrates a transformer and an inductor mounted on a circuit board according to the prior art. The transformer 10 and the inductor 11 are disposed on the circuit board 1. A terminal 102 of a secondary winding coil 101 of the transformer 10 and a terminal 112 of a conductive wire 111 of the inductor 11 are respectively welded on corresponding bonding pads of the circuit board 1. In addition, the transformer 10 and the inductor 11 are electrically connected with each other through a trace pattern (not shown) of the circuit board 1.

Since the transformer 10 and the inductor 11 are separate components, a lot of space of the circuit board 1 is occupied by the transformer 10 and the inductor 11. Under this circumstance, the layout flexibility of other electronic components is deteriorated, and it is difficult to reduce the overall volume of the electronic device. Moreover, since the transformer 10 and the inductor 11 are electrically connected with each other through a trace pattern of the circuit board 1, the process of mounting the transformer 10 and the inductor 11 is complicated and the power loss is increased. Under this circumstance, the power conversion efficiency of the electronic device is impaired.

Therefore, there is a need of providing an integrated magnetic element in order to obviate the drawbacks encountered in the prior art.

SUMMARY OF THE INVENTION

The present invention provides an integrated magnetic element with a transformer and an inductor. Since the integrated magnetic element is a combination of a transformer and an inductor through a conductive base, the space utilization of the circuit board is enhanced, the power loss resulting from the trace pattern is reduced, and the heat-dissipating efficacy is increased. Under this circumstance, the volume of the electronic device is reduced, and the electronic device can meet the small-sized and high power-efficiency requirements.

In accordance with an aspect of the present invention, there is provided an integrated magnetic element. The integrated magnetic element includes a conductive base, a bobbin, a winding coil, a first magnetic core assembly, and a second magnetic core assembly. The conductive base includes a first conductive unit, a second conductive unit and a connecting part. The first conductive unit includes a plurality of first conductive winding parts. The second conductive unit includes at least one second conductive winding part. The connecting part is arranged between the first conductive unit and the second conductive unit for connecting the first conductive unit and the second conductive unit. Each of the first conductive winding parts has a first hole. The second conductive winding part has a second hole. The bobbin includes a bobbin body, a winding section, a channel and a plurality of insertion slots. The channel runs through the bobbin body. The insertion slots are in communication with the channel. The first conductive winding parts are inserted into corresponding insertion slots of the bobbin. The first holes of the first conductive winding parts are aligned with and in communication with the channel. The winding coil is wound around the winding section of the bobbin. The first magnetic core assembly is sheathed around the bobbin and partially embedded into the channel of the bobbin and the first holes of the first conductive winding parts. The second magnetic core assembly is sheathed around the second conductive unit of the conductive base and partially embedded into the second hole of the second conductive winding part.

In accordance with another aspect of the present invention, there is provided an integrated magnetic element. The integrated magnetic element includes a transformer, an inductor and a connecting part. The transformer comprises a first conductive unit, a bobbin, a winding coil and a first magnetic core assembly. The first conductive unit comprises a plurality of first conductive winding parts, and each of the first conductive winding parts has a first hole. The bobbin comprises a bobbin body, a winding section, a channel and a plurality of insertion slots. The channel runs through the bobbin body, and the insertion slots are in communication with the channel. The first conductive winding parts are inserted into corresponding insertion slots of the bobbin, and the first holes of the first conductive winding parts are aligned with and in communication with the channel. The winding coil is wound around the winding section of the bobbin. The first magnetic core assembly is sheathed around the bobbin and partially embedded into the channel of the bobbin and the first holes of the first conductive winding parts. The inductor comprises a second conductive unit and a second magnetic core assembly. The second conductive unit comprises at least one second conductive winding part, and the second conductive winding part has a second hole. The second magnetic core assembly is sheathed around the second conductive unit of the conductive base and partially embedded into the second hole of the second conductive winding part. The connecting part is arranged between the first conductive unit and the second conductive unit for connecting the transformer and the inductor. The first conductive unit, the second conductive unit and the connecting part are integrally formed as a conductive base.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
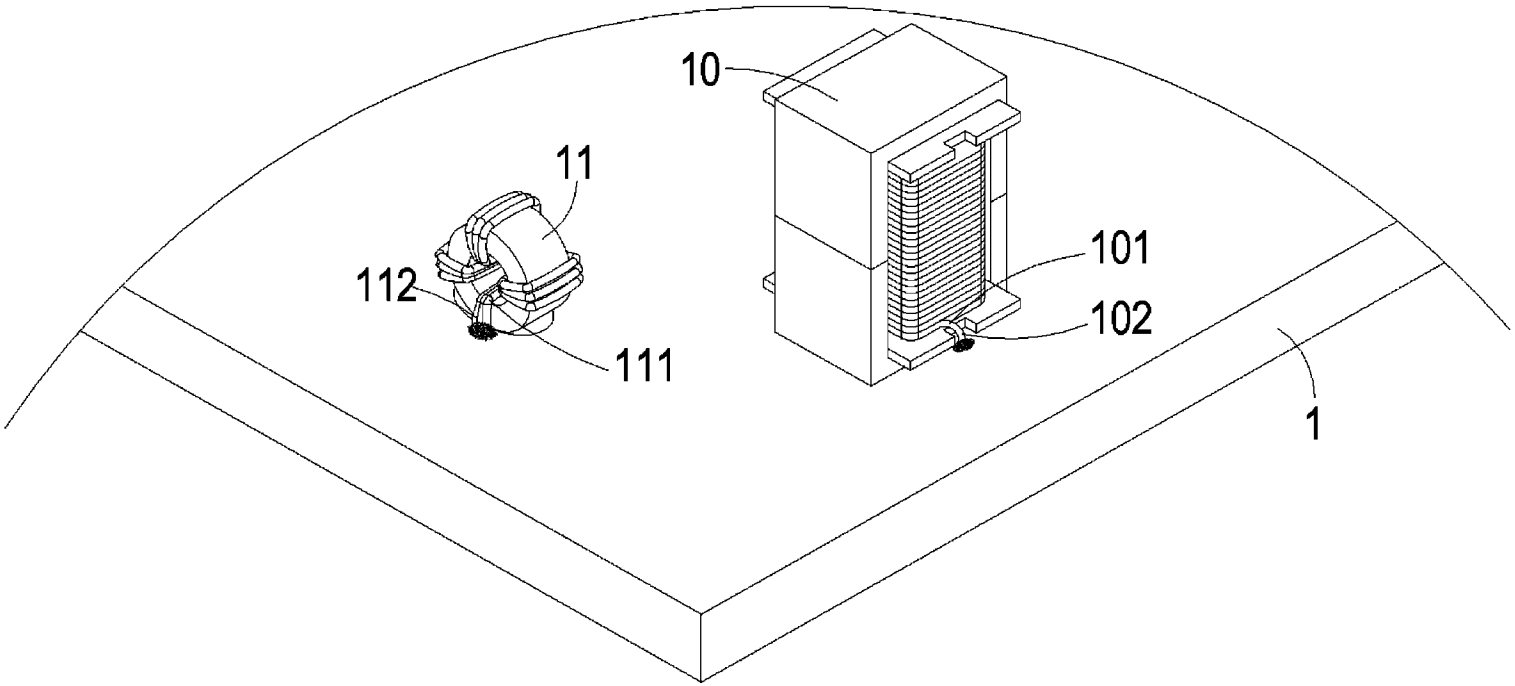
FIG. 1 (PRIOR ART)
FIG. 1 schematically illustrates a transformer and an inductor mounted on a circuit board according to the prior art.
Figure 2A:
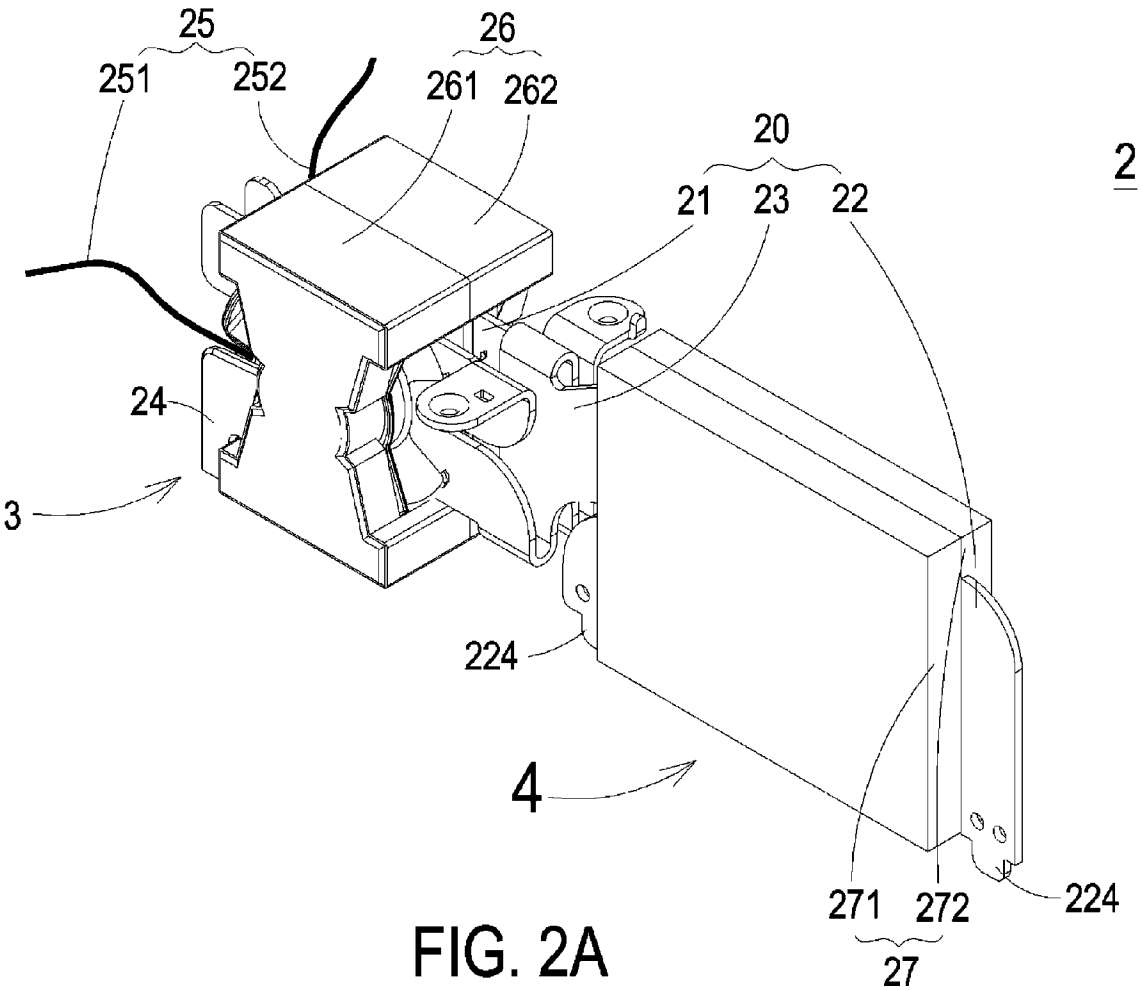
FIG. 2A is a schematic assembled view illustrating an integrated magnetic element according to an embodiment of the present invention.
Figure 2B:
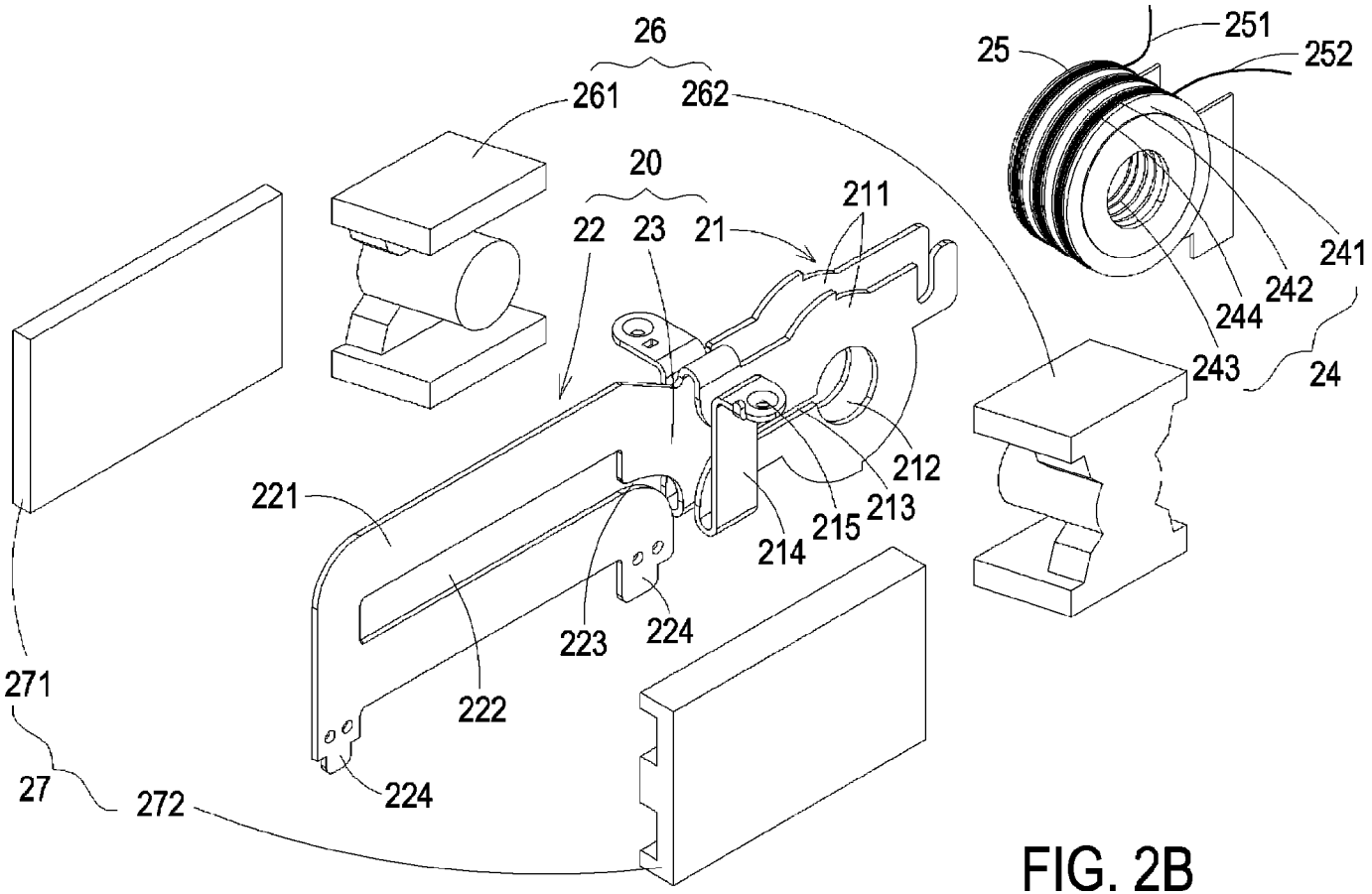
FIG. 2B is a schematic exploded view illustrating the integrated magnetic element of FIG. 2A.

FIG. 2A is a schematic assembled view illustrating an integrated magnetic element according to an embodiment of the present invention. FIG. 2B is a schematic exploded view illustrating the integrated magnetic element of FIG. 2A. Please refer to FIGS. 2A and 2B. The integrated magnetic element 2 of the present invention may be disposed on a circuit board of an electronic device (e.g. a switching power supply). The integrated magnetic element 2 comprises a conductive base 20, a bobbin 24, a winding coil 25, a first magnetic core assembly 26 and a second magnetic core assembly 27.

The conductive base 20 comprises a first conductive unit 21, a second conductive unit 22 and a connecting part 23. The first conductive unit 21 comprises a plurality of first conductive winding parts 211. The second conductive unit 22 comprises at least one second conductive winding part 221. The connecting part 23 is arranged between the first conductive unit 21 and the second conductive unit 22 for connecting the first conductive unit 21 and the second conductive unit 22. In other words, the plurality of first conductive winding parts 211 and the second conductive winding part 221 are connected with each other through the connecting part 23. Each of the first conductive winding parts 211 has a first hole 212. The second conductive winding part 221 has a second hole 222. In this embodiment, the first conductive unit 21, the second conductive unit 22 and the connecting part 23 are integrally formed. Moreover, the conductive base 20 has a plurality of pins 224. These pins 224 are extended outwardly from the second conductive unit 22 and inserted into a circuit board (not shown).

The bobbin 24 comprises a bobbin body 241, a winding section 242, a channel 243 and a plurality of insertion slots 244. The channel 243 runs through the bobbin body 241. The insertion slots 244 are in communication with the channel 243. The winding coil 25 is wound around the winding section 242 of the bobbin 24. In addition, the winding coil 25 comprises a first connecting terminal 251 and a second connecting terminal 252. The first conductive winding parts 211 of the first conductive unit 21 are inserted into corresponding insertion slots 244 of the bobbin 24. Moreover, the first holes 212 of the first conductive winding parts 211 are aligned with the channel 243 and in communication with the channel 243.

The first magnetic core assembly 26 comprises a first magnetic core 261 and a second magnetic core 262. The first magnetic core assembly 26 is sheathed around the bobbin 24 and partially embedded into the channel 243 of the bobbin 24 and the first holes 212 of the first conductive winding parts 211.

The second magnetic core assembly 27 comprises a third magnetic core 271 and a fourth magnetic core 272. The second magnetic core assembly 27 is sheathed around the second conductive unit 22 of the conductive base 20 and partially embedded into the second hole 222 of the second conductive winding part 221.

In this embodiment, the first conductive unit 21 of the conductive base 20, the bobbin 24, the winding coil 25 and the first magnetic core assembly 26 are collaboratively defined as a transformer 3. The winding coil 25 is served as the primary winding coil of the transformer 3. The first conductive unit 21 of the conductive base 20 is served as the secondary winding coil of the transformer 3. Moreover, the second conductive unit 22 of the conductive base 20 and the second magnetic core assembly 27 are collaboratively defined as an inductor 4. The second conductive unit 22 is served as a winding module of the inductor 4.

In some embodiments, the conductive base 20 is made of a rigid metal plate. Moreover, the conductive base 20 is produced by trimming a single metal plate and folding the metal plate into a three-dimensional winding structure. Since the conductive base 20 is made of a metallic material, the conductive base 20 may conduct a large magnitude of current and quickly dissipate heat.

Each of the first conductive winding parts 211 is a ring-shaped, rectangular or polygonal structure with a first seam 213. The second conductive winding part 221 is a ring-shaped, rectangular or polygonal structure with a second seam 223. Moreover, the shape and diameter of the first hole 212 of each first conductive winding part 211 are substantially identical to the shape and diameter of the channel 243 of the bobbin 24. After the first conductive winding parts 211 are inserted into corresponding insertion slots 244 of the bobbin 24, the first holes 212 of the first conductive winding parts 211 are aligned with and in communication with the channel 243 of the bobbin 24. Consequently, the middle posts of the first magnetic core 261 and the second magnetic core 262 of the first magnetic core assembly 26 are embedded into the channel 243 of the bobbin 24 and the first holes 212 of the first conductive winding parts 211.

In some embodiments, the winding coil 25 is wound around the winding section 242 of the bobbin 24 by a sandwich winding method, so that the leakage inductance is reduced. In this embodiment, the first magnetic core 261 and the second magnetic core 262 of the first magnetic core assembly 26 are collaboratively formed as an EE-type core assembly or an EI-type core assembly. Similarly, the third magnetic core 271 and the fourth magnetic core 272 of the second magnetic core assembly 27 are collaboratively formed as an EI-type core assembly or an EE-type core assembly.

Please refer to FIG. 2A again. Since the conductive base 20 is integrally formed and the transformer 3 and the inductor 4 are connected with each other through the connecting part 23 of the conductive base 20, the induced current generated by the first conductive unit 21 of the transformer 3 may be directly transmitted to the second conductive unit 22 of the inductor 4. Consequently, the transformer and the inductor are combined together without the need of using the trace pattern of the circuit board. Moreover, since the transformer 3 and the inductor 4 are integrated into the integrated magnetic element 2, after the integrated magnetic element 2 is mounted on the circuit board, the space utilization of the circuit board will be enhanced.

Figure 3:
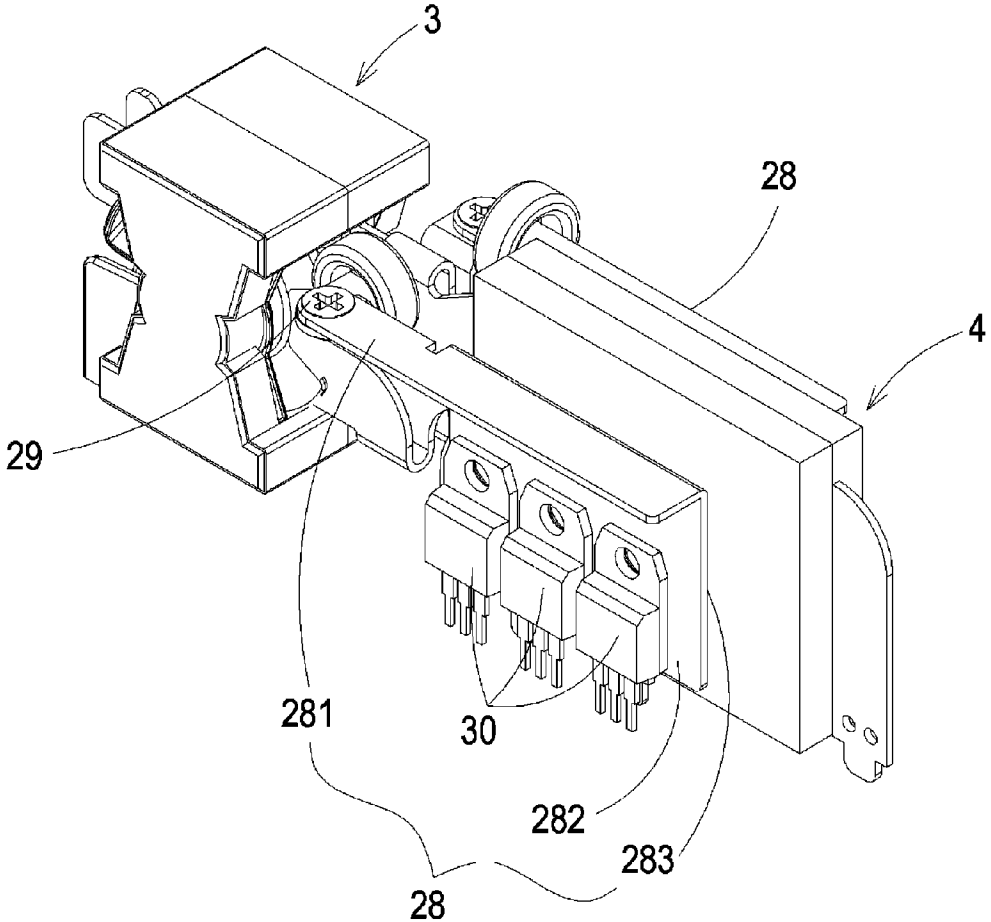
FIG. 3 is a schematic assembled view illustrating an integrated magnetic element according to another embodiment of the present invention.

FIG. 3 is a schematic assembled view illustrating an integrated magnetic element according to another embodiment of the present invention. Please refer to FIGS. 3 and 2B. The configurations and functions of the conductive base 20, the transformer 3 and the inductor 4 included in the integrated magnetic element 2 of this embodiment are similar to those of the embodiment of FIG. 2, and are not redundantly described herein. Moreover, the first conductive unit 21 of the conductive base 20 further comprises at least one extension part 214. The extension part 214 is extended outwardly from the first conductive winding parts 211 and then folded relative to the first conductive winding parts 211. Moreover, a fixing part 215 is formed at a distal end of the extension part 214.

Please refer to FIG. 3 again. The integrated magnetic element 2 further comprises one or more heat-dissipating plates 28. In this embodiment, the integrated magnetic element 2 comprises two heat-dissipating plates 28, which are respectively located at opposite sides of the inductor 4. In this embodiment, the heat-dissipating plate 28 is an L-shaped plate, and comprises a fixing edge 281, a first surface 282 and a second surface 283. Through a fastening element 29 (e.g. a screw), the fixing edge 281 and the fixing part 215 of the conductive base 20 are connected with each other. Consequently, the second surface 283 of the heat-dissipating plate 28 is located beside the inductor 4. Since the heat-dissipating plate 28 may increase the dissipating area, the heat-dissipating efficiency of the integrated magnetic element 2 is enhanced. In some embodiment, one or more electronic components 30 (e.g. transistors) are disposed on the first surface 282 of the heat-dissipating plate 28. The heat-dissipating plate 28 may facilitate fixing the electronic components 30 and removing heat from the electronic components 30.

As previously described in the prior art, since the transformer and the inductor are separately mounted on the circuit board, the space utilization is reduced and the power loss is increased. According to the present invention, since the integrated magnetic element is a combination of a transformer and an inductor through a conductive base, the space utilization of the circuit board is enhanced, the power loss resulting from the trace pattern is reduced, and the heat-dissipating efficacy is increased. Under this circumstance, the volume of the electronic device is reduced, and the electronic device can meet the small-sized and high power-efficiency requirements.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated magnetic element, comprising:

a conductive base comprising a first conductive unit, a second conductive unit and a connecting part, wherein said first conductive unit comprises a plurality of first conductive winding parts, said second conductive unit comprises at least one second conductive winding part, and said connecting part is arranged between said first conductive unit and said second conductive unit for connecting said first conductive unit and said second conductive unit, wherein each of said first conductive winding parts has a first hole, and said second conductive winding part has a second hole;

a bobbin comprising a bobbin body, a winding section, a channel and a plurality of insertion slots, wherein said channel runs through said bobbin body, and said insertion slots are in communication with said channel, wherein said first conductive winding parts are inserted into corresponding insertion slots of said bobbin, and said first holes of said first conductive winding parts are aligned with and in communication with said channel;

a winding coil wound around said winding section of said bobbin;

a first magnetic core assembly sheathed around said bobbin and partially embedded into said channel of said bobbin and said first holes of said first conductive winding parts; and a second magnetic core assembly sheathed around said second conductive unit of said conductive base and partially embedded into said second hole of said second conductive winding part.

2. The integrated magnetic element according to claim 1 wherein said conductive base is made of a metal plate, wherein said first conductive unit, said second conductive unit and said connecting part are integrally formed, and said first conductive winding parts and said second conductive winding part are connected with each other through said connecting part.

3. The integrated magnetic element according to claim 1 wherein said winding coil comprises a first connecting terminal and a second connecting terminal, wherein said winding coil is wound around said winding section of said bobbin by a sandwich winding method.

4. The integrated magnetic element according to claim 1 wherein said first magnetic core assembly comprises a first magnetic core and a second magnetic core, and said second magnetic core assembly comprises a third magnetic core and a fourth magnetic core.

5. The integrated magnetic element according to claim 1 wherein said first conductive unit of said conductive base, said bobbin, said winding coil and said first magnetic core assembly are defined as a transformer, wherein said winding coil is a primary winding coil of said transformer, and said first conductive unit of said conductive base is a secondary winding coil of said transformer.

6. The integrated magnetic element according to claim 1 wherein said second conductive unit of said conductive base and said second magnetic core assembly are defined as an inductor, wherein said second conductive unit is a winding module of said inductor.

7. The integrated magnetic element according to claim 1 wherein said first conductive unit of said conductive base further comprises at least one extension part, wherein said extension part is extended outwardly from said first conductive winding parts and folded relative to said first conductive winding parts, wherein a fixing part is formed at a distal end of said extension part.

8. The integrated magnetic element according to claim 7 wherein said integrated magnetic element further comprises at least one heat-dissipating plate, wherein said heat-dissipating plate comprises a fixing edge, a first surface and a second surface, wherein said fixing edge and said fixing part of said conductive base are connected with each other through a fastening element.

9. An integrated magnetic element, comprising:

a transformer comprising:

a first conductive unit comprising a plurality of first conductive winding parts, wherein each of said first conductive winding parts has a first hole;

a bobbin comprising a bobbin body, a winding section, a channel and a plurality of insertion slots, wherein said channel runs through said bobbin body, and said insertion slots are in communication with said channel, wherein said first conductive winding parts are inserted into corresponding insertion slots of said bobbin, and said first holes of said first conductive winding parts are aligned with and in communication with said channel;

a winding coil wound around said winding section of said bobbin; and a first magnetic core assembly sheathed around said bobbin and partially embedded into said channel of said bobbin and said first holes of said first conductive winding parts;

an inductor comprising:

a second conductive unit comprising at least one second conductive winding part, wherein said second conductive winding part has a second hole; and a second magnetic core assembly sheathed around said second conductive unit of said conductive base and partially embedded into said second hole of said second conductive winding part; and a connecting part arranged between said first conductive unit and said second conductive unit for connecting said transformer and said inductor, wherein said first conductive unit, said second conductive unit and said connecting part are integrally formed as a conductive base.

10. The integrated magnetic element according to claim 9 wherein said conductive base is made of a metal plate, and said first conductive winding parts and said second conductive winding part are connected with each other through said connecting part.

* * * * *